US008215472B2

(12) United States Patent
Uesaka et al.

(10) Patent No.: US 8,215,472 B2
(45) Date of Patent: Jul. 10, 2012

(54) BANKNOTE HANDLING MACHINE

(75) Inventors: Sadaaki Uesaka, Hyogo-Ken (JP); Hirofumi Ozaki, Tokyo-To (JP)

(73) Assignee: Glory Ltd., Hyogo-Ken (JP)

( * ) Notice: Subject to any disclaimer, the term of this patent is extended or adjusted under 35 U.S.C. 154(b) by 180 days.

(21) Appl. No.: 12/733,094

(22) PCT Filed: Aug. 30, 2007

(86) PCT No.: PCT/JP2007/066918

§ 371 (c)(1),
(2), (4) Date: Feb. 10, 2010

(87) PCT Pub. No.: WO2009/028073

PCT Pub. Date: Mar. 5, 2009

(65) Prior Publication Data

US 2010/0140045 A1 Jun. 10, 2010

(51) Int. Cl.

| | |
|---|---|
| ***G07D 11/00*** | (2006.01) |
| ***G07F 7/04*** | (2006.01) |
| ***G07F 19/00*** | (2006.01) |

(52) U.S. Cl. ..... 194/206; 235/379; 209/534

(58) Field of Classification Search ..... 194/206, 194/205; 235/379, 380; 209/534
See application file for complete search history.

(56) References Cited

U.S. PATENT DOCUMENTS

| | | | | |
|---|---|---|---|---|
| 6,782,986 | B2 * | 8/2004 | Toda et al. | 194/206 |
| 2005/0139447 | A1 * | 6/2005 | Minamishin et al. | 194/206 |
| 2006/0157390 | A1 * | 7/2006 | Otsuka | 209/534 |

FOREIGN PATENT DOCUMENTS

| | | |
|---|---|---|
| JP | 62-1093 | 1/1987 |
| JP | 11-007568 | 12/1999 |
| JP | 2004-310594 | 4/2004 |

* cited by examiner

*Primary Examiner* — Mark Beauchaine
(74) *Attorney, Agent, or Firm* — Renner, Kenner, Greive, Bobak, Taylor & Weber

(57) ABSTRACT

A banknote handling machine has a taking-in unit that takes in banknotes one by one, a transport unit that transports the banknote taken in by the taking-in unit, a transport state detection unit that detects the transport state of the banknote taken in by the taking-in unit, a recognition unit that recognizes a kind of the banknote transported by the transport unit, first to third stacking units including stackers in which the banknotes transported by the transport unit are stacked, and a control unit that determines an abnormally transported banknote based on the detection result of the transport state detection unit and determines a specific normal banknote, an abnormal banknote, or a non-specific banknote based on the recognition result of the recognition unit, the control unit controlling the transport unit to transport the banknote determined as the specific normal banknote to the first stacking unit, to transport the banknote determined as the abnormal banknote to the second stacking unit, and to transport the banknote determined as the abnormally transported banknote or the non-specific banknote to the third stacking unit.

12 Claims, 10 Drawing Sheets

BANKNOTE HANDLING MACHINE

BACKGROUND OF THE INVENTION

1. Field of the Invention

The present invention relates to a banknote handling machine, and more particularly, to a banknote handling machine that sorts genuine banknotes and banknotes other than genuine banknotes.

2. Related Art

In recent years, there have been many cases where counterfeit notes (for example, counterfeit banknotes) are mixed in genuine banknotes. For example, banknote handling machines, which can authenticate banknotes, have been used in banking organs in order to sort a lot of banknotes.

A banknote handling machine in the conventional art recognizes the kinds (denomination, orientation, face/back, and authenticity) of banknotes, stacks the banknotes in stackers according to the recognition results, and stacks counterfeit notes or abnormally transported banknotes (hereinafter, referred to as "rejected banknotes") in a rejection stacker.

However, since not only are banknotes determined as counterfeit notes sorted, but counterfeit notes and abnormally transported banknotes are mixed in the rejection stacker, there has been a problem in that an operator needs to pick out counterfeit notes from rejected banknotes stacked in the rejection stacker after banknotes are stacked.

SUMMARY OF THE INVENTION

An object of the invention is to efficiently sort banknotes without making an operator pick out counterfeit notes from rejected banknotes.

According to one aspect of the present invention, there is provided a banknote handling machine comprising:

a taking-in unit that takes in banknotes one by one;

a transport unit that transports the banknote taken in by the taking-in unit;

a transport state detection unit that detects the transport state of the banknote taken in by the taking-in unit;

a recognition unit that recognizes a kind of the banknote transported by the transport unit;

first to third stacking units including stackers in which the banknotes transported by the transport unit are stacked; and a control unit that determines an abnormally transported banknote based on the detection result of the transport state detection unit and determines a specific normal banknote, an abnormal banknote, or a non-specific banknote based on the recognition result of the recognition unit, the control unit controlling the transport unit to transport the banknote determined as the specific normal banknote to the first stacking unit, to transport the banknote determined as the abnormal banknote to the second stacking unit, and to transport the banknote determined as the abnormally transported banknote or the non-specific banknote to the third stacking unit.

According to one aspect of the present invention, there is provided a banknote handling machine comprising:

a taking-in unit that takes in banknotes one by one;

a transport unit that transports the banknote taken in by the taking-in unit;

a transport state detection unit that detects the transport state of the banknote taken in by the taking-in unit;

a recognition unit that recognizes a kind of the banknote transported by the transport unit;

first to third stacking units including stackers in which the banknotes transported by the transport unit are stacked; and a control unit that determines an abnormally transported banknote based on the detection result of the transport state detection unit and determines a specific normal banknote, a specific abnormal banknote, or a non-specific banknote based on the recognition result of the recognition unit, the control unit controlling the transport unit to transport the banknote determined as the specific normal banknote to the first stacking unit, to transport the banknote determined as the specific abnormal banknote to the second stacking unit, and to transport the banknote determined as the abnormally transported banknote or the non-specific banknote to the third stacking unit.

According to the invention, it may be possible to efficiently sort banknotes without making an operator pick out counterfeit notes from rejected banknotes.

DETAILED DESCRIPTION OF THE INVENTION

Embodiments of the invention will be described below with reference to drawings. Meanwhile, the following embodiments are examples of embodiments of the invention, and do not limit the scope of the invention.

First Embodiment

A first embodiment of the invention will be described first.

Figure 1:
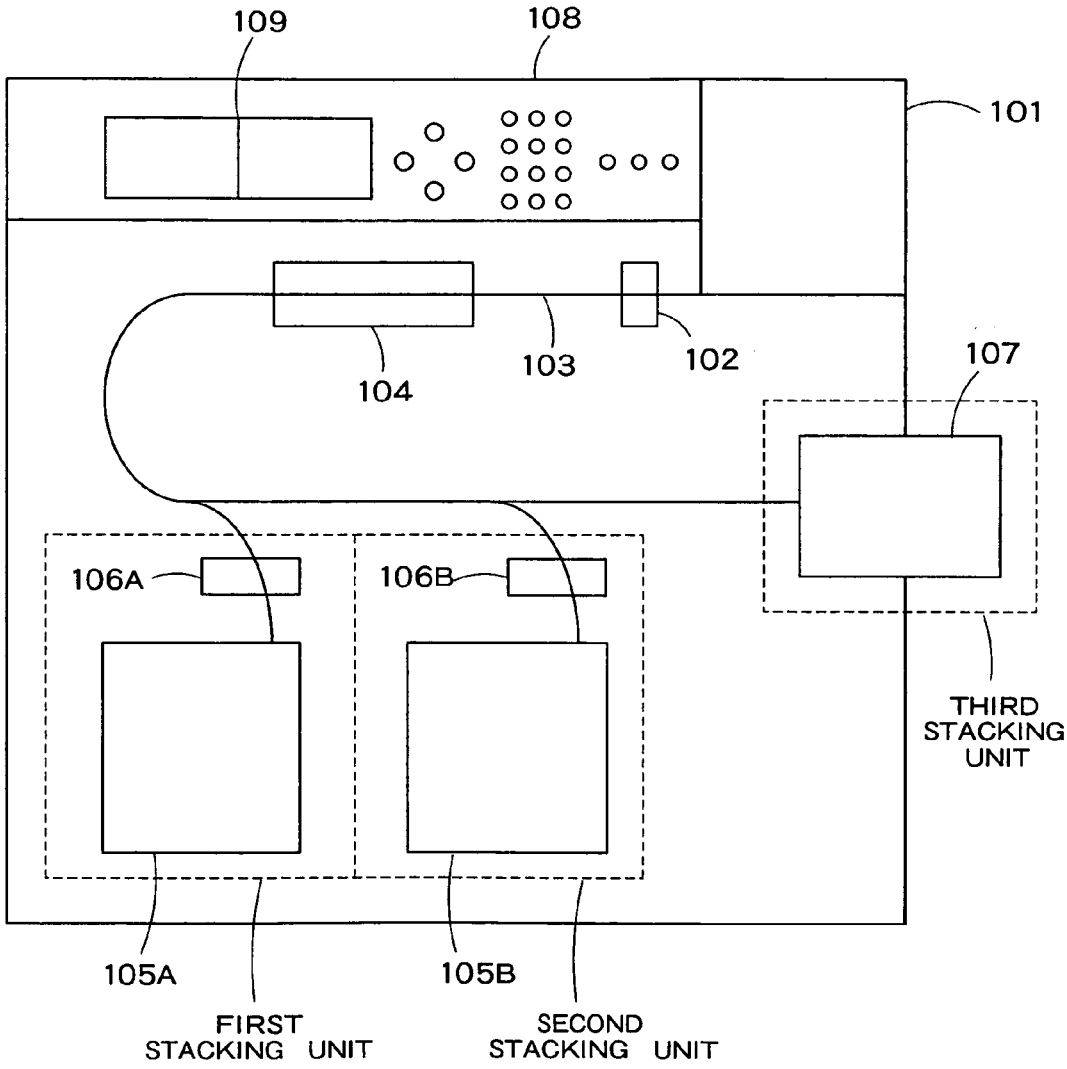
FIG. 1 is a front view illustrating the configuration of a banknote handling machine according to a first embodiment of the invention.

FIG. 1 is a front view illustrating the configuration of a banknote handling machine according to a first embodiment of the invention.

The banknote handling machine according to the first embodiment of the invention includes a taking-in unit 101, a transport state detection unit 102, a transport unit 103, a recognition unit 104, a first stacking unit, a second stacking unit, a third stacking unit, a designation unit 108 and a display unit 109.

The taking-in unit 101 takes in banknotes one by one from placed batches of banknotes. The taking-in unit 101 operates according to a control unit 110 to be described below.

The transport state detection unit 102 is a sensor that detects the transport state of the banknote taken in by the taking-in unit 101. When detecting the transport abnormality, the transport state detection unit 102 sends an abnormal transport signal to the control unit 110 to be described below. For example, the transport state detection unit 102 sends an abnormal transport signal to the control unit 110 in a state (skewed state) where a banknote is obliquely taken in by the taking-in unit 101, a state (chained state) where a plurality of banknotes are taken in without predetermined intervals, and a state (double-fed state) where a plurality of banknotes are taken in while overlapping.

The transport unit 103 is a transport mechanism for transporting the banknote, which is taken in by the taking-in unit 101, to the first stacking unit, the second stacking unit, or the third stacking unit. The transport unit 103 has the shape of a horizontal U-shaped transport path in FIG. 1, and is formed of a mechanism including a diverter that includes a plurality of transport belts, transport rollers, and diverter claws. The transport unit 103 operates according to the control unit 110 to be described below.

The recognition unit 104 is a sensor for recognizing the kind of the banknote (denomination, authenticity, fitness of the banknote) that is transported by the transport unit 103. When recognizing the kind of the banknote, the recognition unit 104 sends a recognition signal, which represents the result of the recognition, to the control unit 110 to be described below. Meanwhile, the recognition unit 104 has been provided on the rear side of the transport state detection unit 102. However, the recognition unit 104 may be provided on the front side of the transport state detection unit 102 or may be formed integrally with the transport state detection unit 102.

The first stacking unit includes a stacker 105A in which the banknotes transported by the transport unit 103 are stacked, and a counter 106A that counts the banknotes stacked in the stacker 105A.

The second stacking unit includes a stacker 105B in which the banknotes transported by the transport unit 103 are stacked, and a counter 106B that counts the banknotes stacked in the stacker 105B.

The first and second stackers 105A and 105B includes openings that are opened in the same direction, and display panels that display the count results of the counters 106A and 106B, respectively.

The counters 106A and 106B count the banknotes stacked in the first and second stackers 105A and 105B, and send signals, which represent the count results, to the display panels of the first and second stackers 105A and 105B and the control unit 110 to be described below.

Meanwhile, the number of the stackers of the first stacking unit is not limited, and the number of the counters 106 is the same as the number of the stackers of the first stacking unit.

The third stacking unit includes a stacker 107 in which the banknotes transported by the transport unit 103 are stacked. The third stacking unit is provided at a position closer to the taking-in unit 101 than the first and second stacking units. Preferably, the third stacking unit is provided at the end of the U-shaped transport belt under the taking-in unit 101.

The stacker 107 includes openings that are opened in the several directions including a direction facing the taking-in unit 101, and a movable stopper that prevents the springing-out of the stacked banknotes. The most number of stacked banknotes of the stacker 107 is smaller than that of the stacker 105A of the first stacking unit and that of the stacker 105B of the second stacking unit.

The designation unit 108 includes a plurality of instruction keys that is used to receive the instruction of an operator. When the operator presses the instruction key, the designation unit 108 sends a signal, which indicates the pressed instruction key, to the control unit 110 to be described below.

The display unit 109 includes two liquid crystal displays that display predetermined images. The display unit 109 appropriately displays image data, which are sent from the control unit 110 to be described below, on the two liquid crystal displays.

Figure 2:
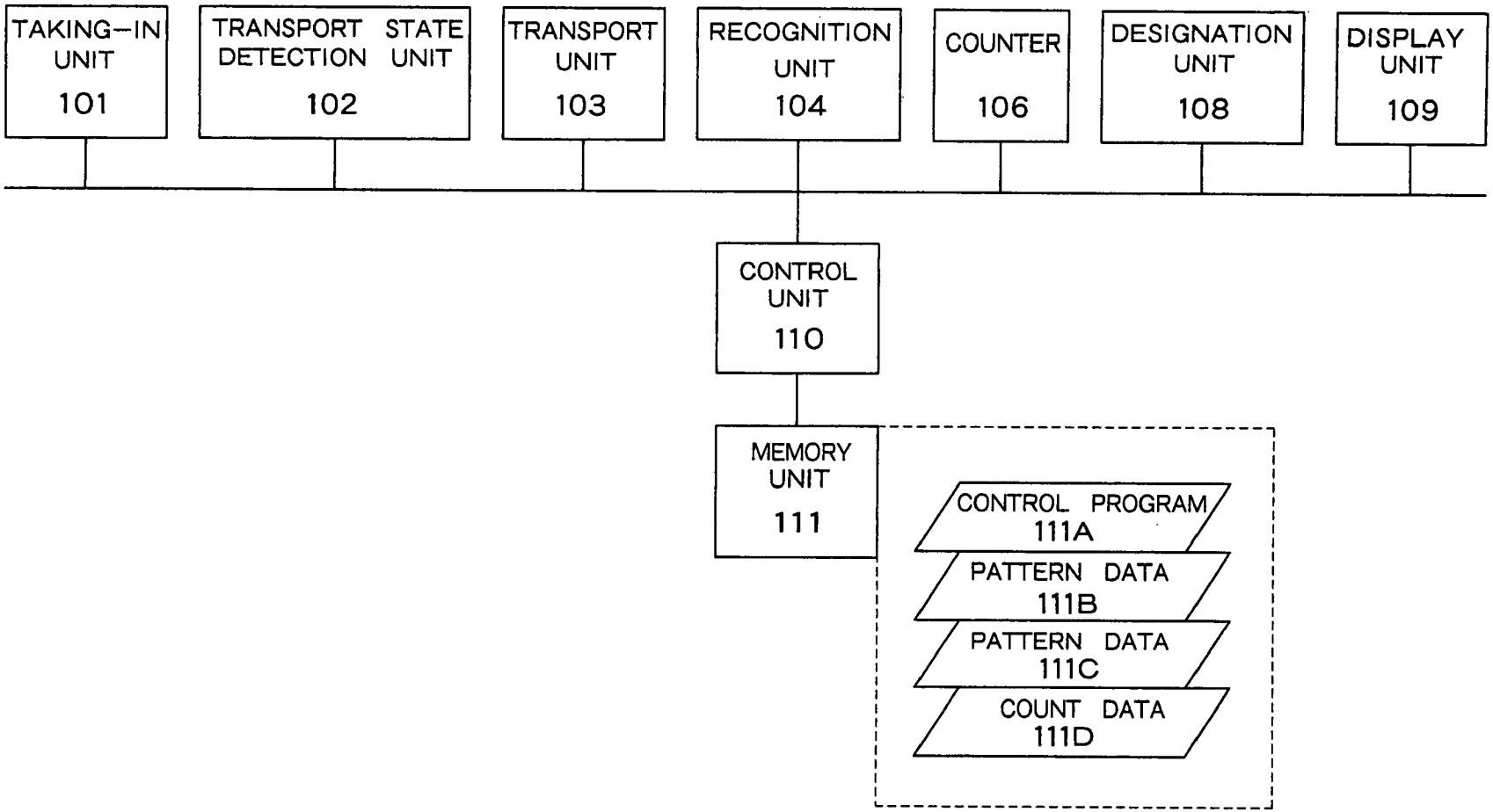
FIG. 2 is a block diagram of a control system of the banknote handling machine according to the first embodiment of the invention.

FIG. 2 is a block diagram of a control system of the banknote handling machine according to the first embodiment of the invention.

The banknote handling machine according to the first embodiment of the invention includes a control unit 110 and a memory unit 111.

The control unit 110 is connected to the taking-in unit 101, the transport state detection unit 102, the transport unit 103, the recognition unit 104, the counter 106, the designation unit 108, the display unit 109, and the memory unit 111. The control unit 110 operates according to a control program 111A to be described below. The control unit 110 sends/receives signals or data to/from the taking-in unit 101, the transport state detection unit 102, the transport unit 103, the recognition unit 104, the counter 106, the designation unit 108, and the display unit 109. The control unit 110 reads/writes data from/in the memory unit 111.

The memory unit 111 is a memory that stores a control program 111A, pattern data 111B and 111C, and count data 111D.

The control program 111A is a program module that stores the operation of the control unit 110.

The pattern data 111B and 111C include program modules that store a handling procedure of the control unit 110 for executing patterns 1 and 2 to be described below, and image data that represent the patterns 1 and 2. Meanwhile, the pattern data 111 may include three kinds of pattern data.

The count data 111D are data that represent the count results of the counters 106A and 106B.

Figure 3:
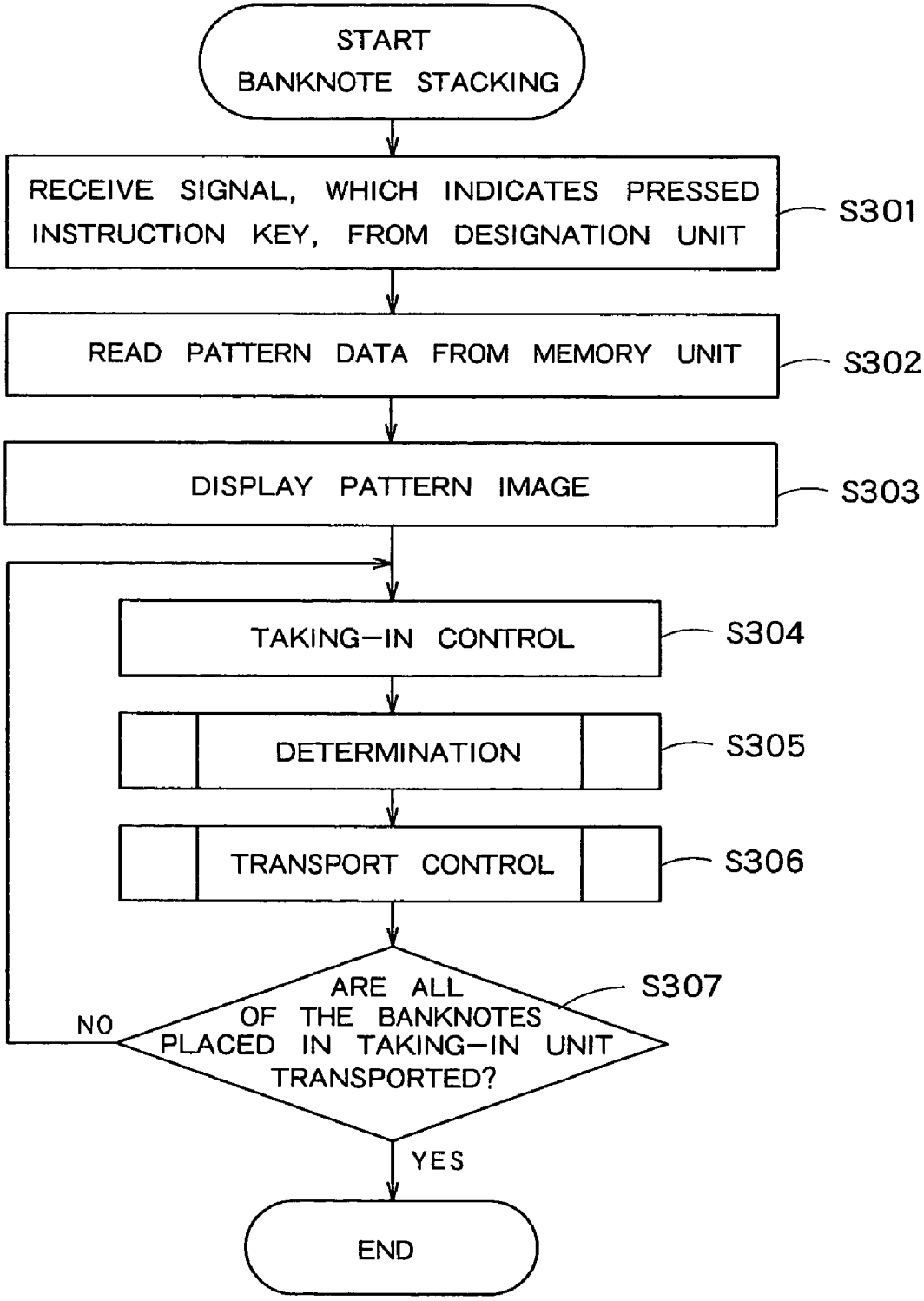
FIG. 3 is a flowchart illustrating a handling procedure of the control unit 110 in the banknote stacking according to the first embodiment of the invention.

FIG. 3 is a flowchart illustrating a handling procedure of the control unit 110 in the banknote stacking according to the first embodiment of the invention. The banknote stack handling according to the first embodiment of the invention is performed according to the control program 111A.

First, the control unit 110 receives a signal, which indicates the pressed instruction key, sent from the designation unit 108 (S301).

Then, the control unit 110 reads any of the pattern data 111B and 111C from the memory unit 111 according to the signal that is received in S301 (S302).

After that, the control unit 110 controls the display unit 109 so as to display a pattern image according to any image data of the pattern data 111B and 111C that is read in S302 (S303).

Sequentially, the control unit 110 controls the taking-in unit 101 to take in the placed banknotes one by one (S304).

After that, the control unit 110 performs the following determination according to an abnormal transport signal sent from the transport state detection unit 102 or a recognition signal sent from the recognition unit 104 (S305).

The control unit 110 activates any program module of the pattern data 111B and 111C that are read in S302, and performs a transport control to be described below (S306).

S304 to S306 are repeatedly performed until all of the banknotes placed in the taking-in unit 101 are transported (NO in S307). If all of the banknotes placed in the taking-in unit 101 are transported (YES in S307), the banknote stack handling according to the embodiment of the invention is completed.

Figure 4:
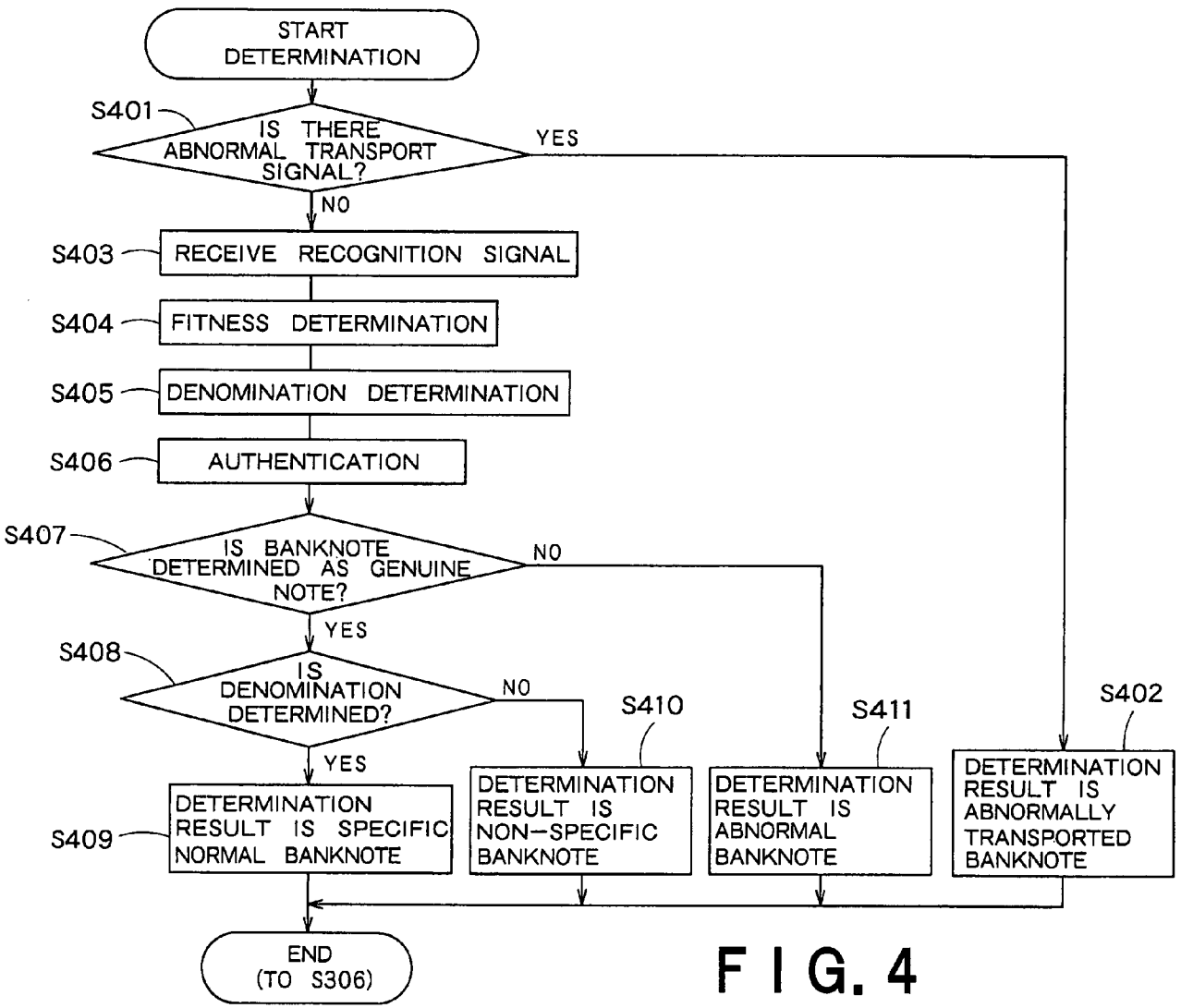
FIG. 4 is a flowchart illustrating a handling procedure of the control unit 110 in the determination according to the first embodiment of the invention.

FIG. 4 is a flowchart illustrating a handling procedure of the control unit 110 in the determination according to the first embodiment of the invention.

First, if an abnormal transport signal is sent from the transport state detection unit 102 (YES in S401), the control unit 110 determines an abnormally transported banknote as a determination result (S402).

Meanwhile, if an abnormal transport signal is not sent from the transport state detection unit 102 (NO in S401), the control unit 110 receives a recognition signal sent from the recognition unit 104 (S403).

After that, the control unit 110 performs fitness-unfitness determination (S404) for determining whether the shape of the banknote has abnormality, denomination determination (S405) for determining the denomination of the banknote, and authentication (S406) for determining whether the banknote is a genuine note, according to the recognition signal that is received in S403.

If the banknote is determined as a genuine note in S406 (YES in S407) and the denomination of the banknote is determined in S405 (YES in S408), the control unit 101 determines a specific normal banknote as a determination result (S409).

If the banknote is determined as a genuine note in S406 and the denomination of the banknote is not determined in S405 (NO in S408), the control unit 101 determines a non-specific banknote as a determination result (S410).

In contrast, if the banknote is not determined as a genuine note in S406 (NO in S407), the control unit 101 determines an abnormal banknote as a determination result (S411).

In S405, the control unit 110 may determine a banknote of one previously designated denomination as a specific banknote, and may determine a banknote of any of a plurality of previously designated denominations as a specific banknote.

The control unit 110 jumps to S306 of FIG. 3 after performing any of S402 and S409 to S411.

Figure 5:
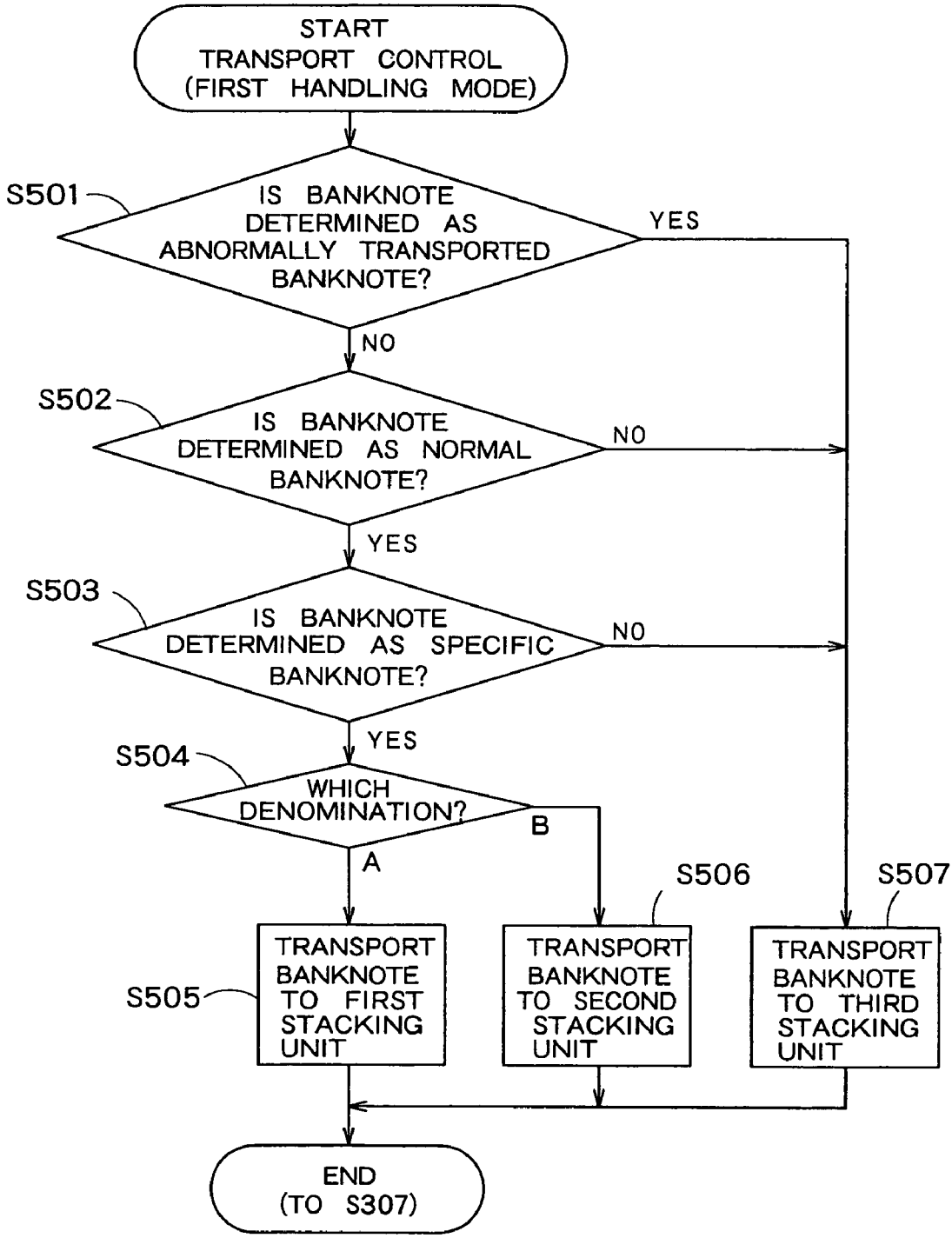
FIG. 5 is a flowchart illustrating a handling procedure of the control unit 110 in the transport control (first handling mode) according to the first embodiment of the invention.

FIG. 5 is a flowchart illustrating a handling procedure of the control unit 110 in the transport control (first handling mode) according to the first embodiment of the invention. The transport control (first handling mode) according to the first embodiment of the invention is performed according to the program module of the pattern data 111B.

First, if the banknote is not determined as an abnormally transported banknote (NO in S501) and the banknote is determined as a specific normal banknote (YES in S502 and YES in S503), the control unit 110 controls the transport unit 103 to transport the banknote of a denomination A to the stacker 105A of the first stacking unit (A in S504 and S505) and controls the transport unit 103 to transport the banknote of a denomination B to the stacker 105B of the second stacking unit (B in S504 and S506).

Meanwhile, if the banknote is determined as an abnormally transported banknote (YES in S501), if the banknote is determined as an abnormal banknote (NO in S502), or if the banknote is determined as a non-specific banknote (YES in S502 and NO in S503), the control unit 110 controls the transport unit 103 to transport the banknote determined as an abnormally transported banknote, a non-specific banknote, or an abnormal banknote to the stacker 107 of the third stacking unit (S507).

The control unit 110 jumps to S307 of FIG. 3 after performing any of S505 to S507.

Figure 6:
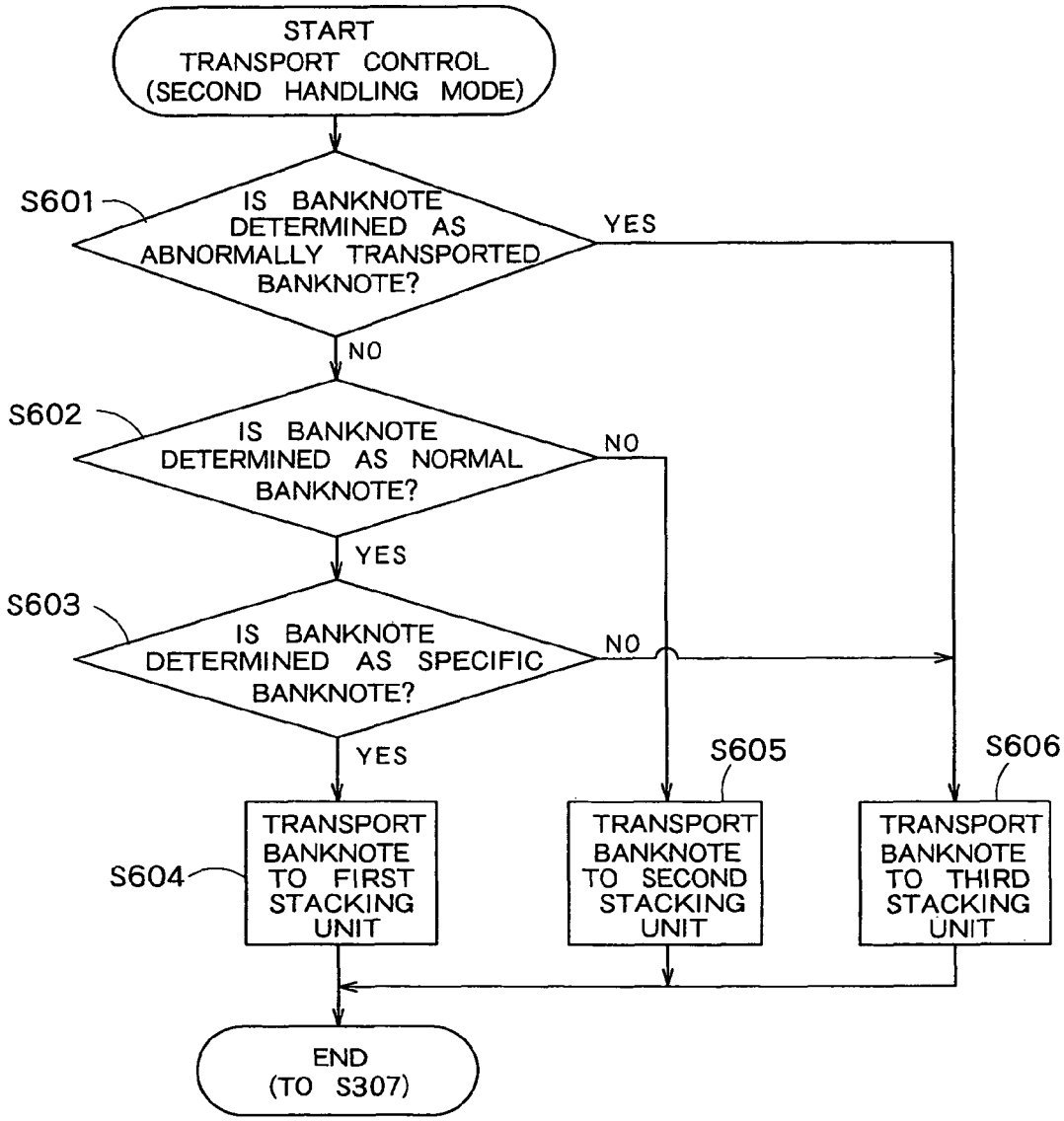
FIG. 6 is a flowchart illustrating a handling procedure of the control unit 110 in the transport control (second handling mode) according to the first embodiment of the invention.

FIG. 6 is a flowchart illustrating a handling procedure of the control unit 110 in the transport control (second handling mode) according to the first embodiment of the invention. The transport control (second handling mode) according to the first embodiment of the invention is performed according to the program module of the pattern data 111C.

First, if the banknote is not determined as an abnormally transported banknote (NO in S601) and a banknote is determined as a specific normal banknote (YES in S602 and YES in S603), the control unit 110 controls the transport unit 103 to transport the banknote determined as a specific normal banknote to the stacker 105A of the first stacking unit (S604).

Meanwhile, if the banknote is not determined as an abnormally transported banknote (NO in S601) and the banknote is determined as an abnormal banknote (NO in S602), the control unit controls the transport unit 103 to transport the banknote determined as an abnormal banknote to the stacker 105B of the second stacking unit (S605).

In contrast, if the banknote is determined as an abnormally transported banknote (YES in S601) or the banknote is not determined as an abnormally transported banknote (NO in S601) and the banknote is determined as a non-specific banknote (YES in S602 and NO in S603), the control unit controls the transport unit 103 to transport the banknote determined as an abnormally transported banknote or a non-specific banknote to the stacker 107 of the third stacking unit (S606).

The control unit 110 jumps to S307 of FIG. 3 after performing any of S604 to S606.

Figure 7:
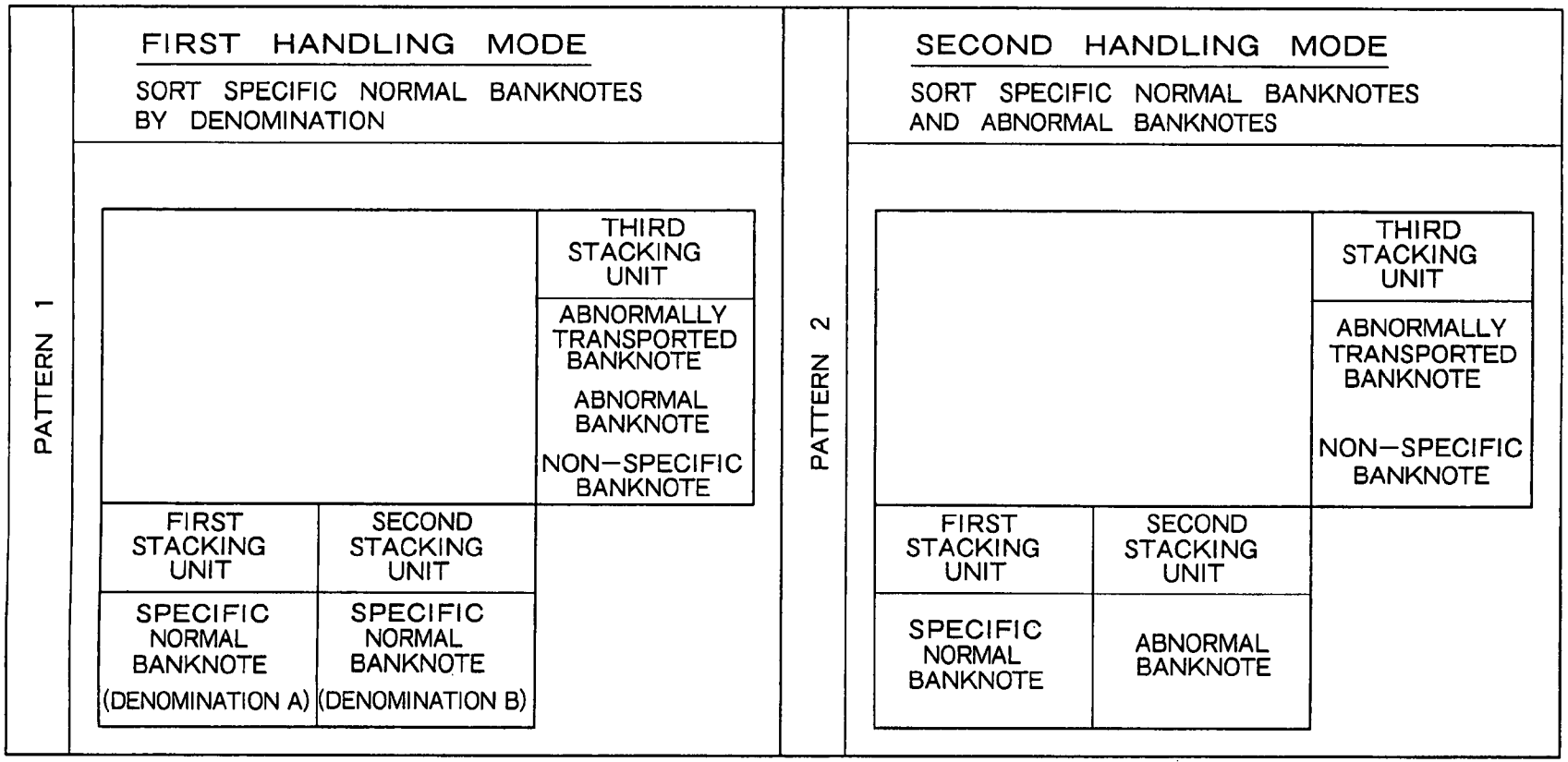
FIG. 7 is a schematic view illustrating a display example of a pattern screen that is displayed on the display unit 109 according to the first embodiment of the invention.

FIG. 7 is a schematic view illustrating a display example of a pattern screen that is displayed on the display unit 109 according to the first embodiment of the invention.

When the image data included in the pattern data 111B is sent in S303 of FIG. 3, the display unit 109 according to the first embodiment of the invention displays the pattern image of the pattern 1 on the liquid crystal displays. The pattern 1 is a pattern that performs a first handling mode for sorting specific normal banknotes by denomination.

When the image data included in the pattern data 111C is sent in S303 of FIG. 3, the display unit 109 according to the first embodiment of the invention displays the pattern image of the pattern 2 on the liquid crystal displays. The pattern 2 is a pattern that performs a second handling mode for sorting specific normal banknotes and abnormal banknotes.

According to the first embodiment of the invention, a banknote determined as an abnormal banknote is stacked in a stacker different from the stackers in which the banknotes determined as a specific normal banknote, an abnormally transported banknote, and a non-specific banknote are stacked. Accordingly, an operator does not need to sort abnormal banknotes, so that it may be possible to efficiently sort abnormal banknotes.

Second Embodiment

A second embodiment of the invention will be described below. In the second embodiment of the invention, banknotes determined as an abnormally transported banknote and an abnormal banknote are transported to a second stacking unit corresponding to a transport state. Meanwhile, the same description as the description of the first embodiment of the invention will not be repeated.

Figure 8:
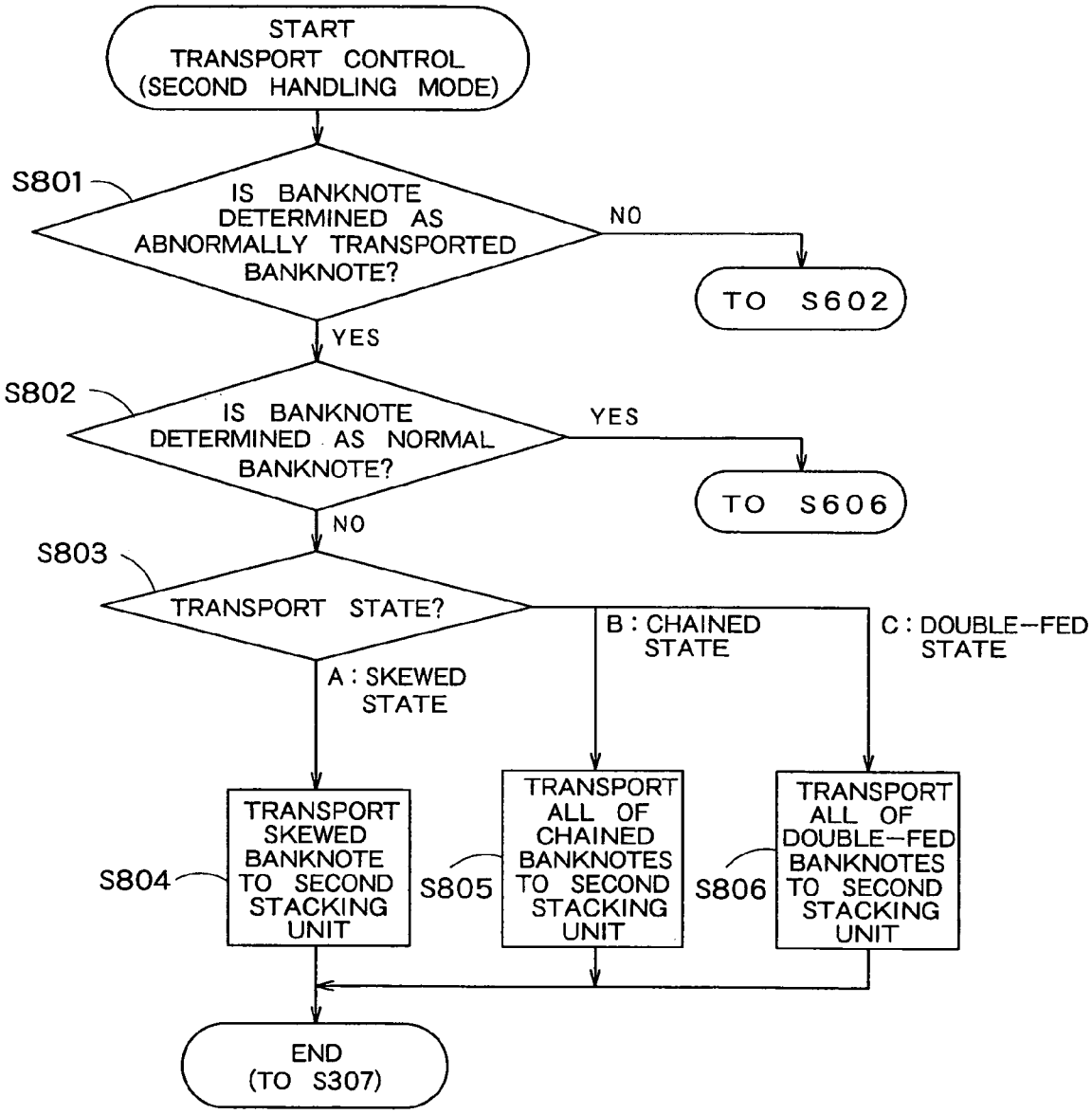
FIG. 8 is a flowchart illustrating a handling procedure of the control unit 110 in the transport control (second handling mode) according to a second embodiment of the invention.

FIG. 8 is a flowchart illustrating a handling procedure of the control unit 110 in the transport control (second handling mode) according to the second embodiment of the invention. The transport control (second handling mode) according to the second embodiment of the invention is performed according to the program module of the pattern data 111C.

First, if the banknote is determined as an abnormally transported banknote (YES in S801) and the banknote is determined as an abnormal banknote (YES in S801 and NO in S802), the control unit 110 controls the transport unit 103 to transport the banknote determined as an abnormally transported banknote and an abnormal banknote to the second stacking unit according to the transport state (S803 to S806).

If it is determined that the banknote is in a skewed state (A in S803), the control unit 110 controls the transport unit 103 to transport a skewed banknote to the second stacking unit (S804).

Meanwhile, if it is determined that the banknote is in a chained state (B in S803), at least one of chained banknotes in the chained state is an abnormal banknote. Accordingly, the control unit controls the transport unit 103 to transport all of the chained banknotes to the second stacking unit (S805).

In contrast, if it is determined that the banknote is in a double-fed state (C in S803), at least one of double-fed banknotes in the double-fed state is an abnormal banknote. Accordingly, the control unit controls the transport unit 103 to transport all of the double-fed banknotes to the second stacking unit (S806).

Further, if the banknote is not determined as an abnormally transported banknote (NO in S801), the control unit 110 jumps to S602 of FIG. 6. If the banknote is not determined as a normal banknote (YES in S802), the control unit jumps to S606 of FIG. 6.

The control unit 110 jumps to S307 of FIG. 3 after performing any of S804 to S806.

According to the second embodiment, if at least one abnormal banknote is included in abnormally transported banknotes, the control unit controls the transport unit 103 to transport the banknote to the second stacking unit corresponding to the transport state. Accordingly, it may be possible to stack banknotes so that the abnormally transported banknote is completely isolated from the abnormal banknote.

Third Embodiment

A third embodiment of the invention will be described below. In the third embodiment of the invention, specific banknotes determined as a specific banknote are sorted into a normal banknote and an abnormal banknote. Meanwhile, the same description as the description of the first and second embodiments of the invention will not be repeated.

Figure 9:
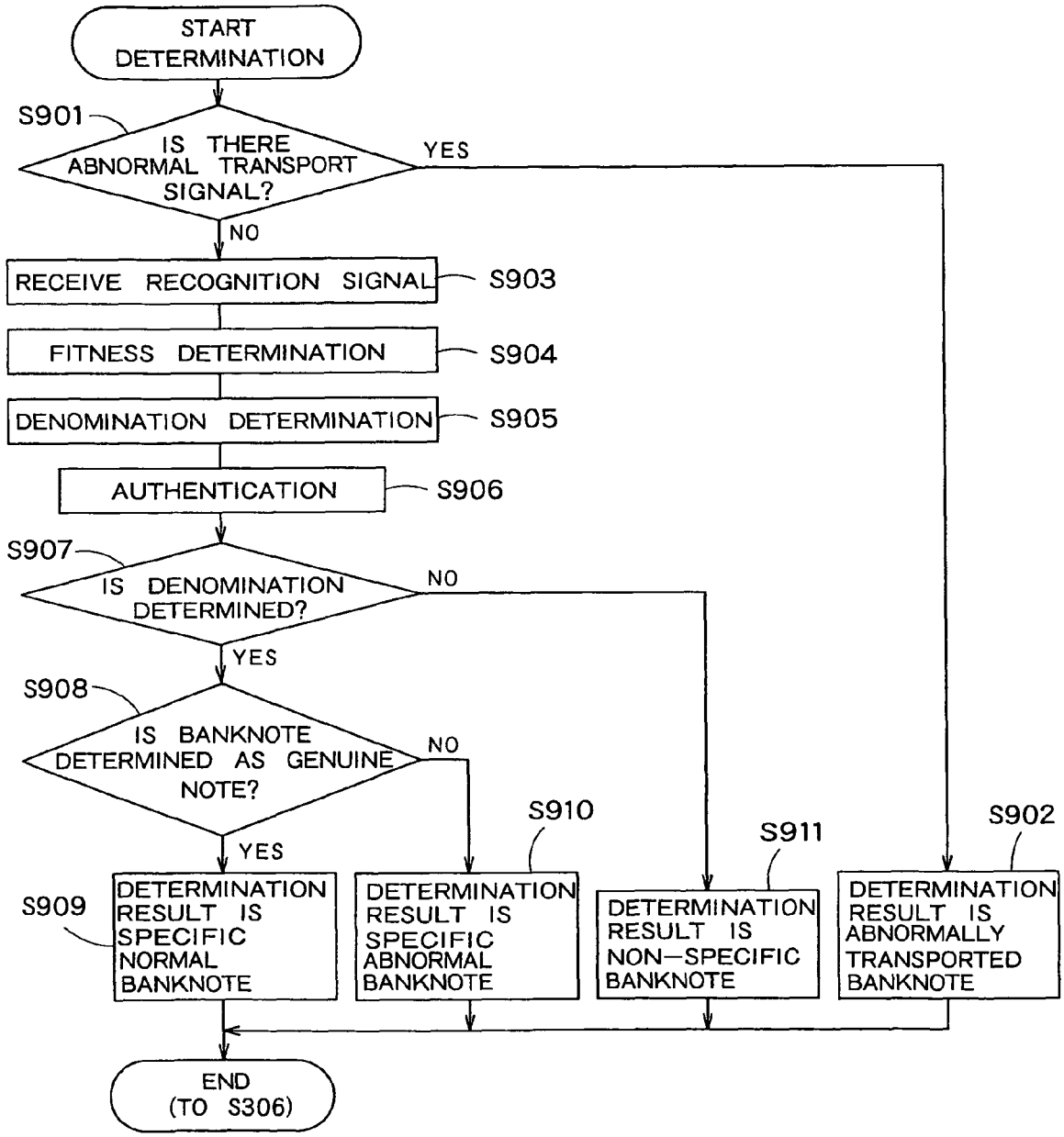
FIG. 9 is a flowchart illustrating a handling procedure of the control unit 110 in the determination according to a third embodiment of the invention.

FIG. 9 is a flowchart illustrating a handling procedure of the control unit 110 in the determination according to the third embodiment of the invention.

First, if an abnormal transport signal is sent from the transport state detection unit 102 (YES in S901), the control unit 110 determines an abnormally transported banknote as a determination result (S902).

Meanwhile, if an abnormal transport signal is not sent from the transport state detection unit 102 (NO in S901), the control unit 110 receives a recognition signal sent from the recognition unit 104 (S903).

After that, the control unit 110 performs fitness-unfitness determination (S904) for determining whether the shape of the banknote has abnormality, denomination determination (S905) for determining the denomination of the banknote when the banknote is a banknote, and authentication (S906) for determining whether the banknote is a genuine note when the banknote is a banknote, according to the recognition signal that is received in S903.

If the denomination of the banknote is determined in S905 (YES in S907) and the banknote is determined as a genuine note in S906 (YES in S908), the control unit 101 determines a specific normal banknote as a determination result (S909).

If the denomination of the banknote is determined in S905 (YES in S907) and the banknote is not determined as a genuine note in S906 (NO in S908), the control unit 101 determines a specific abnormal banknote as a determination result (S910).

In contrast, if the denomination of the banknote is not determined in S905 (NO in S907), the control unit 101 determines a non-specific banknote as a determination result (S911).

In S905, the control unit 110 may determine a banknote of one previously designated denomination as a specific banknote, and may determine a banknote of any of a plurality of previously designated denominations as a specific banknote.

The control unit 110 jumps to S306 of FIG. 3 after performing any of S902 and S909 to S911.

Figure 10:
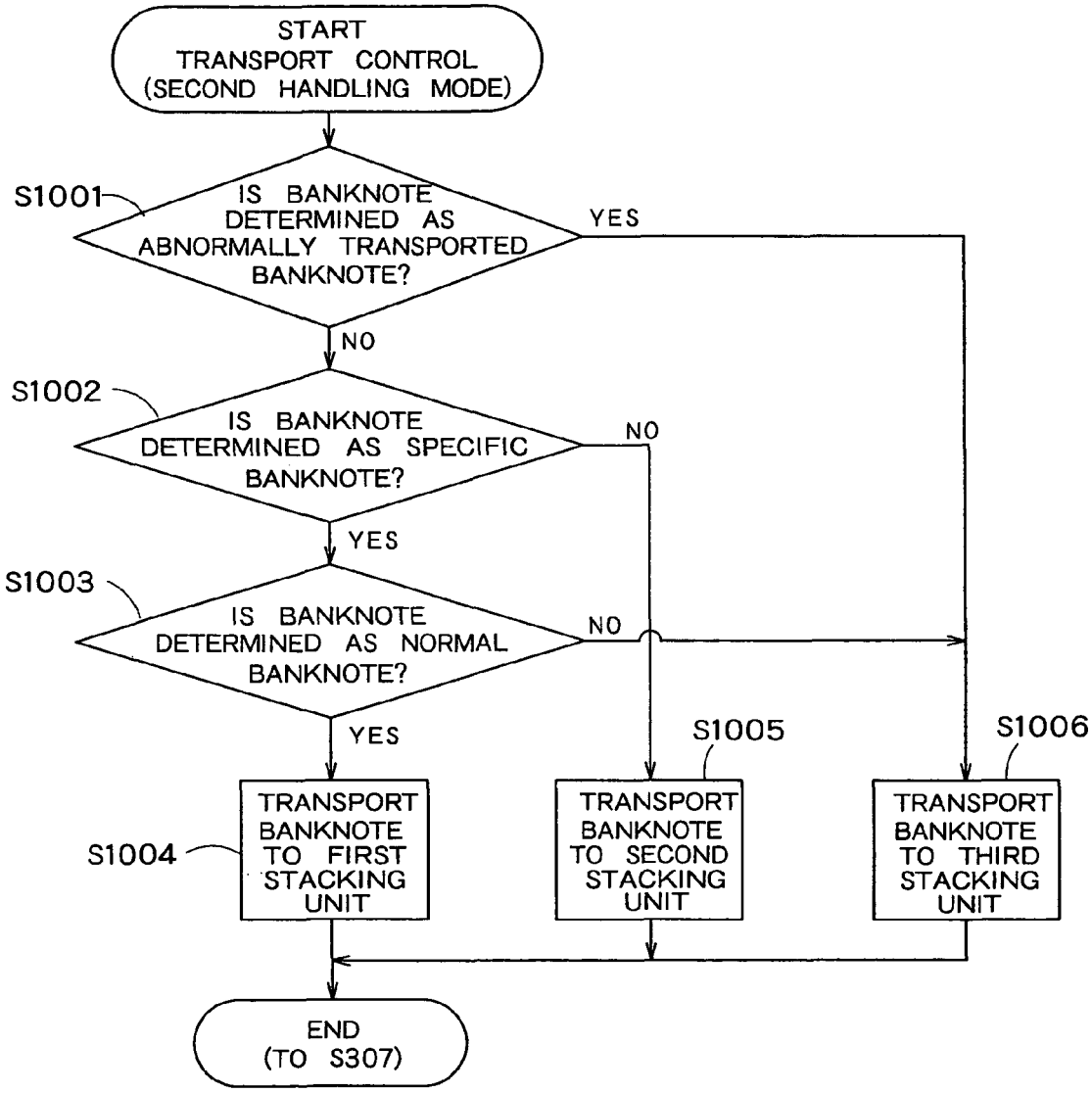
FIG. 10 is a flowchart illustrating a handling procedure of the control unit 110 in the transport control (second handling mode) according to the third embodiment of the invention.

FIG. 10 is a flowchart illustrating a handling procedure of the control unit 110 in the transport control (second handling mode) according to the third embodiment of the invention. The transport control (second handling mode) according to the third embodiment of the invention is performed according to the program module of the pattern data 111C.

First, if the banknote is not determined as an abnormally transported banknote (NO in S1001) and the banknote is determined as a specific normal banknote (YES in S1002 and YES in S1003), the control unit 110 controls the transport unit 103 to transport the banknote determined as a specific normal banknote to the stacker 105A of the first stacking unit (S1004).

Meanwhile, if the banknote is not determined as an abnormally transported banknote (NO in S1001) and the banknote is determined as a specific abnormal banknote (YES in S1002 and NO in S1003), the control unit controls the transport unit 103 to transport the banknote determined as a specific abnormal banknote to the stacker 105B of the second stacking unit (S1005).

In contrast, if the banknote is determined as an abnormally transported banknote (YES in S1001) or the banknote is not determined as an abnormally transported banknote (NO in S1001) and the banknote is determined as a non-specific banknote, the control unit controls the transport unit 103 to transport the banknote determined as an abnormally transported banknote or a non-specific banknote to the stacker 107 of the third stacking unit (S1006).

The control unit 110 jumps to S307 of FIG. 3 after performing any of S1004 to S1006.

What is claimed is:

1. A banknote handling machine comprising:

a taking-in unit that takes in banknotes one by one;

a transport unit that transports the banknote taken in by the taking-in unit;

a transport state detection unit that detects the transport state of the banknote taken in by the taking-in unit;

a recognition unit that recognizes a kind of the banknote transported by the transport unit;

first to third stacking units including stackers in which the banknotes transported by the transport unit are stacked; and a control unit that determines an abnormally transported banknote based on the detection result of the transport state detection unit and determines a specific normal banknote, an abnormal banknote, or a non-specific banknote based on the recognition result of the recognition unit, the control unit controlling the transport unit to transport the banknote determined as the specific normal banknote to the first stacking unit, to transport the banknote determined as the abnormal banknote to the second stacking unit, and to transport the banknote determined as the abnormally transported banknote and the banknote determined as the non-specific banknote to the third stacking unit.

2. The banknote handling machine according to claim 1, wherein the recognition unit recognizes the denomination and authenticity of the banknote, the control unit determines a banknote, which is recognized as a genuine note of a predetermined denomination by the recognition unit, as the specific normal banknote, the control unit determines a banknote, which is not recognized as a genuine note, as the abnormal banknote, and the control unit determines a banknote, which is not recognized as a banknote of a predetermined denomination, as the non-specific banknote.

3. The banknote handling machine according to claim 2, wherein the control unit determines a banknote, which is recognized as a banknote of a predetermined denomination by the recognition unit and is recognized as a counterfeit note or a substantially counterfeit note, as the abnormal banknote.

4. The banknote handling machine according to claim 1, wherein if a skewed banknote, which is determined as the abnormally transported banknote from a skew transport state detected by the transport state detection unit, is determined as the abnormal banknote, the control unit controls the transport unit to transport the skewed banknote to the second stacking unit.

5. The banknote handling machine according to claim 1, wherein if at least one of chained banknotes, which are determined as the abnormally transported banknotes from a chain transport state detected by the transport state detection unit, is determined as the abnormal banknote, the control unit controls the transport unit to transport all of the chained banknotes to the second stacking unit.

6. The banknote handling machine according to claim 1, wherein if at least one of double-fed banknotes, which are determined as the abnormally transported banknotes from a double-fed state detected by the transport state detection unit, is determined as the abnormal banknote, the control unit controls the transport unit to transport all of the double-fed banknotes to the second stacking unit.

7. The banknote handling machine according to claim 1, wherein the number of banknotes, which the stacker of the third stacking unit is capable of stacking, is smaller than the number of banknotes which each stacker of the first and second stacking units is capable of stacking.

8. A banknote handling machine comprising:

a taking-in unit that takes in banknotes one by one;

a transport unit that transports the banknote taken in by the taking-in unit;

a transport state detection unit that detects the transport state of the banknote taken in by the taking-in unit;

a recognition unit that recognizes a kind of the banknote transported by the transport unit;

first to third stacking units including stackers in which the banknotes transported by the transport unit are stacked; and a control unit that determines an abnormally transported banknote based on the detection result of the transport state detection unit and determines a specific normal banknote, a specific abnormal banknote, or a non-specific banknote based on the recognition result of the recognition unit, the control unit controlling the transport unit to transport the banknote determined as the specific normal banknote to the first stacking unit, to transport the banknote determined as the specific abnormal banknote to the second stacking unit, and to transport the banknote determined as the abnormally transported banknote and the banknote determined as the non-specific banknote to the third stacking unit.

9. The banknote handling machine according to claim 8, wherein the recognition unit recognizes the denomination and authenticity of the banknote, the control unit determines a banknote, which is recognized as a genuine note of a predetermined denomination by the recognition unit, as the specific normal banknote, the control unit determines a banknote, which is recognized as a banknote of a predetermined denomination and is not recognized as a genuine note, as the specific abnormal banknote, and the control unit determines a banknote, which is not recognized as a banknote of a predetermined denomination, as the non-specific banknote.

10. A banknote handling machine comprising:

a taking-in unit that takes in banknotes one by one;

a transport unit that transports the banknote taken in by the taking-in unit;

a transport state detection unit that detects the transport state of the banknote taken in by the taking-in unit;

a recognition unit that recognizes a kind of the banknote transported by the transport unit;

first to third stacking units including stackers in which the banknotes transported by the transport unit are stacked;

a designation unit that designates handling modes representing sort patterns for sorting the banknotes to be stacked in the first to third stacking units; and a control unit that determines an abnormally transported banknote based on the detection result of the transport state detection unit and determines a specific normal banknote, and abnormal banknote, or a non-specific banknote based on the recognition result of the recognition unit;

wherein if a first handling mode is designated by the designation unit, the control unit controls the transport unit to transport a banknote to the first or second stacking unit according to the kind of the banknote determined as the specific normal banknote and to transport a banknote determined as the abnormally transported banknote, a banknote determined as the non-specific banknote, and a banknote determined as the abnormal banknote to the third stacking unit, and if a second handling mode is designated by the designation unit, the control unit controls the transport unit to transport a banknote determined as the specific normal banknote to the first stacking unit, to transport a banknote determined as the abnormal banknote to the second stacking unit, and to transport a banknote determined as the abnormally transported banknote and a banknote determined as the non-specific banknote to the third stacking unit.

11. The banknote handling machine according to claim 10, further comprising:

a memory unit that stores the sort patterns, wherein the designation unit designates the sort pattern stored in the memory unit, and the control unit controls the transport unit according to the sort pattern that is designated by the designation unit.

12. The banknote handling machine according to claim 10, wherein the number of banknotes, which the stacker of the third stacking unit is capable of stacking, is smaller than the number of banknotes which each stacker of the first and second stacking units is capable of stacking.

* * * * *